United States Patent [19]

Land et al.

[11] Patent Number: 4,610,444

[45] Date of Patent: Sep. 9, 1986

[54] CONTROLLING SYSTEM FOR MECHANISMS DELIVERING SHEETS TAKEN OFF FROM A PILE IN A PROCESSING MACHINE

[75] Inventors: Pierre Lang, Ecublens; Georges Meylan, Preverenges, both of Switzerland

[73] Assignee: Bobst SA, Lausanne, Switzerland

[21] Appl. No.: 595,397

[22] Filed: Mar. 30, 1984

[30] Foreign Application Priority Data

Mar. 31, 1983 [CH] Switzerland ..... 1802/83

[51] Int. Cl.[4] ..... B65H 1/08; B65H 3/08; B65H 5/02

[52] U.S. Cl. ..... 271/12; 271/31; 271/98; 271/155; 271/272

[58] Field of Search ..... 271/301, 31, 98, 115, 271/147, 148, 152, 153, 155, 156, 265, 266, 272, 274

[56] References Cited

U.S. PATENT DOCUMENTS

| | | | |
|---|---|---|---|
| 3,446,496 | 5/1969 | Schwebel | 271/31 |
| 3,716,226 | 2/1973 | Kistner | 271/154 |
| 4,077,620 | 3/1978 | Frank et al. | 271/265 X |
| 4,332,124 | 6/1982 | Jaton | 53/540 |

FOREIGN PATENT DOCUMENTS

| | | |
|---|---|---|
| 1070283 | 6/1967 | United Kingdom . |
| 1112243 | 5/1968 | United Kingdom . |
| 2046711 | 11/1980 | United Kingdom . |

OTHER PUBLICATIONS

Phillips, R. A., "Synchronous Stacking Device", Research Disclosure, Jul., 1977, pp. 60–62.

*Primary Examiner*—Bruce H. Stoner, Jr.
*Assistant Examiner*—Lawrence J. Goffney, Jr.
*Attorney, Agent, or Firm*—Hill, Van Santen, Steadman & Simpson

[57] ABSTRACT

A controlling system for mechanisms which deliver sheets taken off from a sheet pile in a processing machine. A first height detecting element for a rear part of the sheet pile and a second height detecting element for a front part of the sheet pile are provided with respective first and second detection fingers. The first and second detecting elements are connected to a command circuit which actuates a reduction motor driving the elevator lifting the sheet pile. The calculator also actuates the motor for the lifting or lowering of the sucking unit. The device is used in devices feeding sheets taken off from the top of a pile into a processing machine.

10 Claims, 11 Drawing Figures

CONTROLLING SYSTEM FOR MECHANISMS DELIVERING SHEETS TAKEN OFF FROM A PILE IN A PROCESSING MACHINE

BACKGROUND OF THE INVENTION

The present invention refers to a controlling system for mechanisms delivering sheets taken off from a pile in a processing machine.

The successive taking off of the uppermost sheet of a sheet pile to form a stream of sheets to be introduced into a printing or cutting press is well known, and there are several devices which achieve this function. But if the material to be processed is cardboard or corrugated board, the poor planar nature of the sheets constituting the pile often creates difficulties. As the cardboard easily buckles under the influence of external factors, like the ambient humidity, the bad stocking conditions, etc., the front part of the pile often does not have the same height as the rear part. Height variations can also appear on the lateral faces of the pile. The sheet infeed devices known so far usually comprise a lifting device which brings the upper sheet to a given level so that it can be fed into the processing machine with an infeed element provided with adequately actuated suckers. In order to ensure a continuous infeed of the sheets, several known devices command the elevation of the lifting device bearing the sheet pile with the help of a sensor detecting the position of the sheet in the proximity of the infeed element provided with suckers. Other devices such as the one described in U.S. Pat. No. 3,446,496 incorporated herein by reference, use a second detection element of the upper sheet on the pile which is located on the front part of the sheet pile and influences, jointly with the sensor, the command of the elevating device.

One of the major drawbacks of such devices lies in the fact that the detection means located on the front of the sheet pile could disturb the command of the elevating device. The pile might either be lifted or lowered too much, and provoke a bad sheet infeed. It is also to be noted that in the above-cited devices, the upper rear part of the pile is never brought near the infeed element provided with suckers without first observing the level of the upper front part of the pile.

SUMMARY OF THE INVENTION

An object of the present invention is to overcome the drawbacks mentioned above in such a way so as to allow a good and accurate feeding of the unplanar cardboard sheets to a processing machine.

DESCRIPTION OF THE PREFERRED EMBODIMENTS

Figure 1:
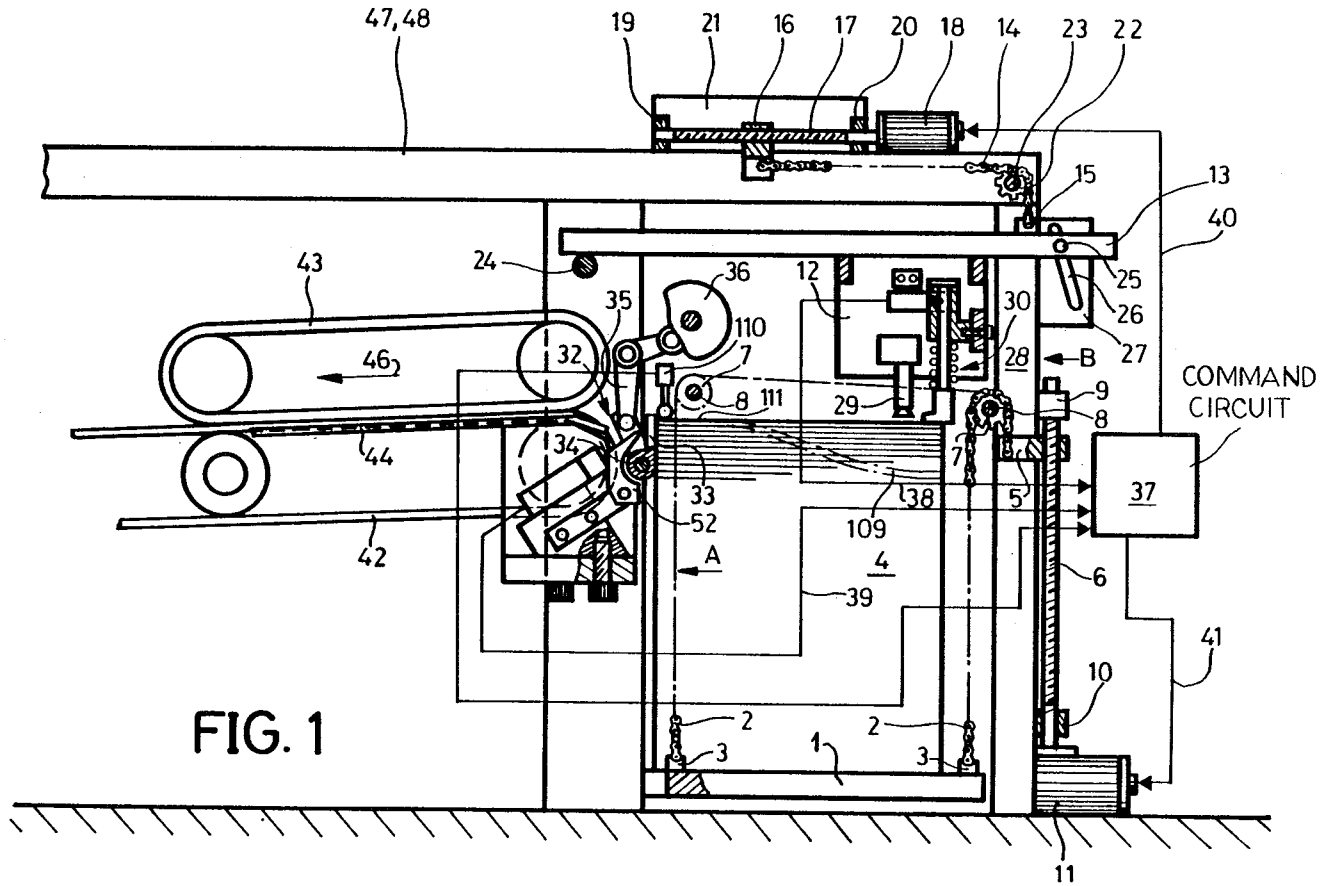
FIG. 1 is a schematic profile view of an infeed station.

The infeed station shown in FIG. 1 comprises a pile elevator with a lifting grate 1 suspended on chains 2. One end of the chains 2 is tied to the grate 1, with four fasteners 3 arranged on each side of the sheet pile 4. The other end of the chains 2 is attached to fixation piece 5 with screws 6. Each chain 2 runs over a sprocket wheel 7 mounted on shafts 8. When the fixation piece 5 shifts, it is, of course, guided by slides (not shown) along the screw 6. The screw 6 is supported by two bearings 9 and 10 driven by a reduction motor 11. The infeed station also comprises a sucking unit 12 mounted on a frame 13 suspended at the one end of both chains 14 with fixation brackets 15. The other end of the chains 14 is tied to a special nut 16 into which a screw 17, driven by a motor 18, engages. The special nut 16 is guided along the screw 17 by slides (not shown). The screw 17 is fastened in the bearings 19 and 20 of the support 21. The chains 14 run over two sprocket wheels 22 mounted on a transversal shaft 23. One end of the frame 13 rests on a bar 24 in a way that it can shift. The other end is provided with two small projections 25 engaging into an oblong groove 26 in the support 27 attached against each lateral post 28 of the frames 47 and 48 of the infeed station. This arrangement warrants an unchanged positioning of the sucking unit 12 with respect to the rear face of the sheet pile 4 when it moves up and down driven by the motor 18. The sucking unit 12 includes several suckers 29 (of which only one is shown to simplify the drawing), and a first detecting element 30 described in detail hereafter. This first detecting element 30 is mounted in the proximity of the upper rear part of the sheet pile 4, on a theoretical axis corresponding to the median theoretical axis 31 of the sheet pile 4 (see FIGS. 2 and 3). A second detecting element 32 is located adjacent the upper front part of the sheet pile 4 on the median theoretical axis 31 of this pile 4. This second detecting element 32 comprises a front stop 33 mounted so that it can pivot on an axis 34. The pivoting of the front stop 33 is achieved by a lever 35 driven by a cam 36. The first detecting element 30 is electrically connected to a command circuit 37 by a cable 38, whereas the second detecting element 32 is also connected to the command circuit 37 by means of the cable 39.

When the command circuit 37 receives a signal from the first detecting element 30, it generates a positive or negative indication to be transmitted by the cable 40 to the motor 18 controlling the vertical movement of the sucking unit 12. When the command circuit 37 receives a signal from the second detecting element 32, it generates a positive indication to be transmitted by the cable 41 to the motor 11 controlling the lifting of the sheet pile 4. On request, such as when a new pile has to be laid onto the elevation grate 1, the motor 11 can be driven independently by means which are known and were not described for the present invention. The infeed station also comprises a set of conveyors 42 and 43 operating with lateral guides 44 to transport the sheet streams 45 (see FIG. 4) towards the processing machine in the direction shown by the arrow 46.

Figure 2:
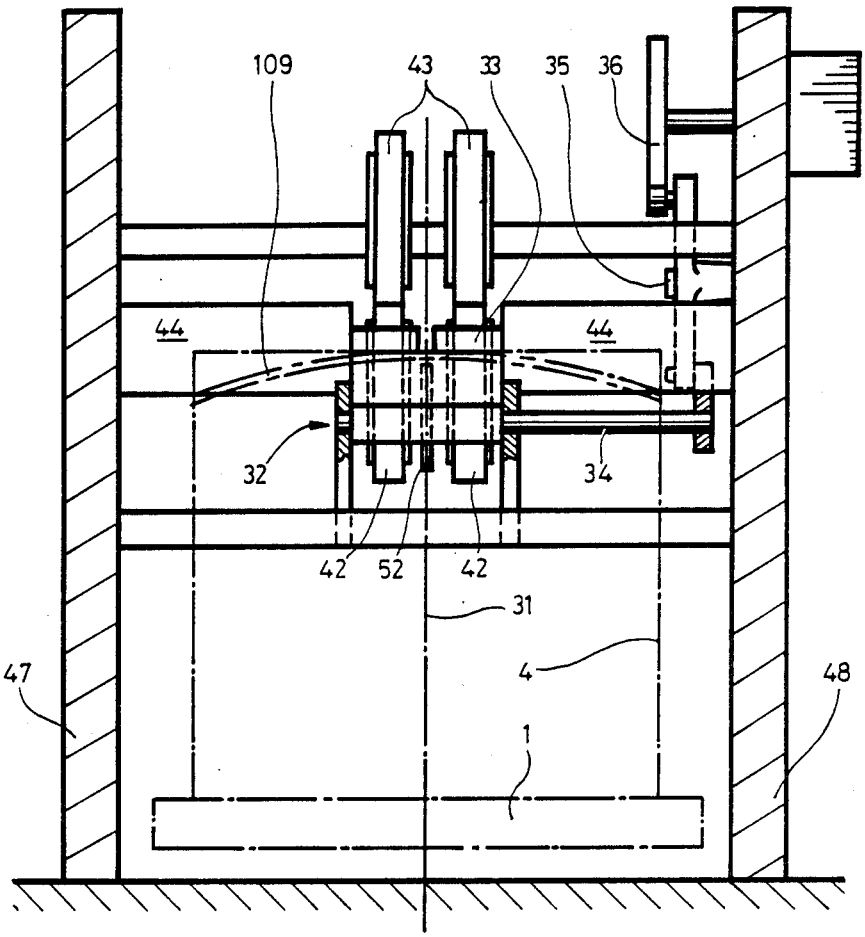
FIG. 2 is a view from a direction A in FIG. 1 showing a second detecting element at a front of the station pile.

FIG. 2 is a view from direction A in FIG. 1, and shows the position of the conveyors 42 and 43 and the second detecting element 32 between the frames 47 and 48 of the infeed station. The conveyors 42 and 43 are arranged on both sides of the median axis 31 of the sheet pile 4 and after it. The stop 33 only acts on the central part of the sheet pile 4.

Figure 3:
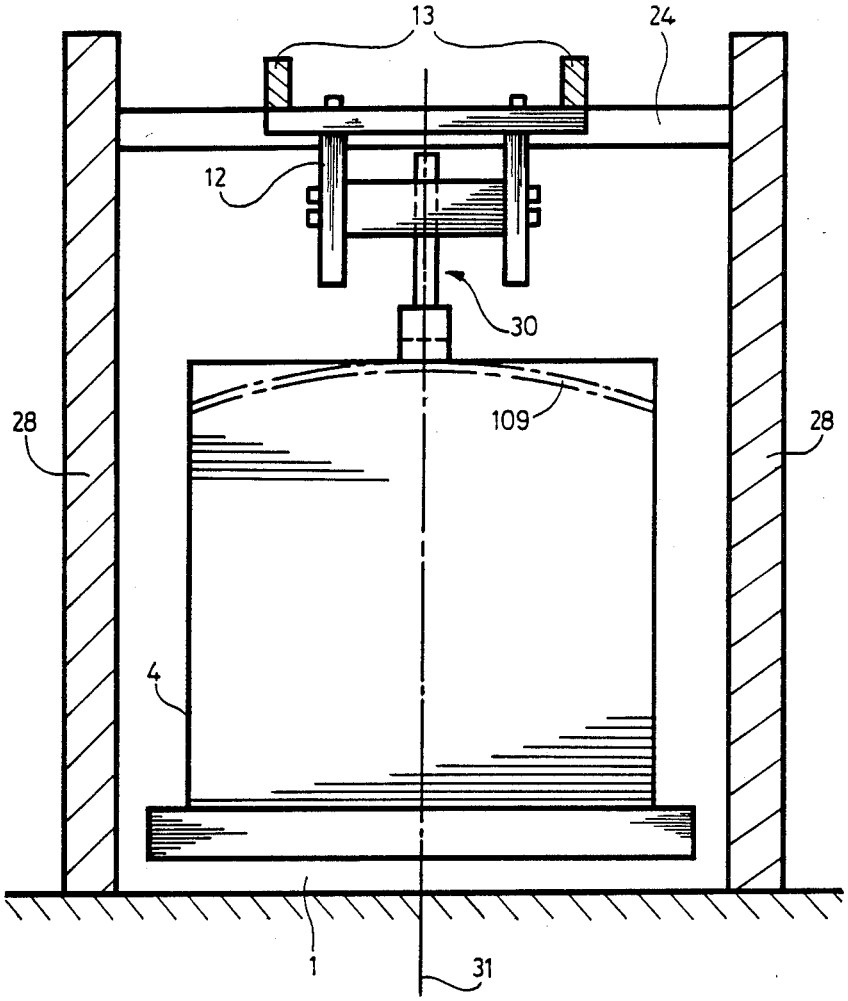
FIG. 3 is a view from a direction B in FIG. 1 showing a first detecting element at a rear of the station pile.

FIG. 3 is a view from direction B in FIG. 1 and shows the sucking unit 12 of the first detecting element 30 between the lateral posts 28 of the frames 47 and 48 of the infeed station.

Figure 4:
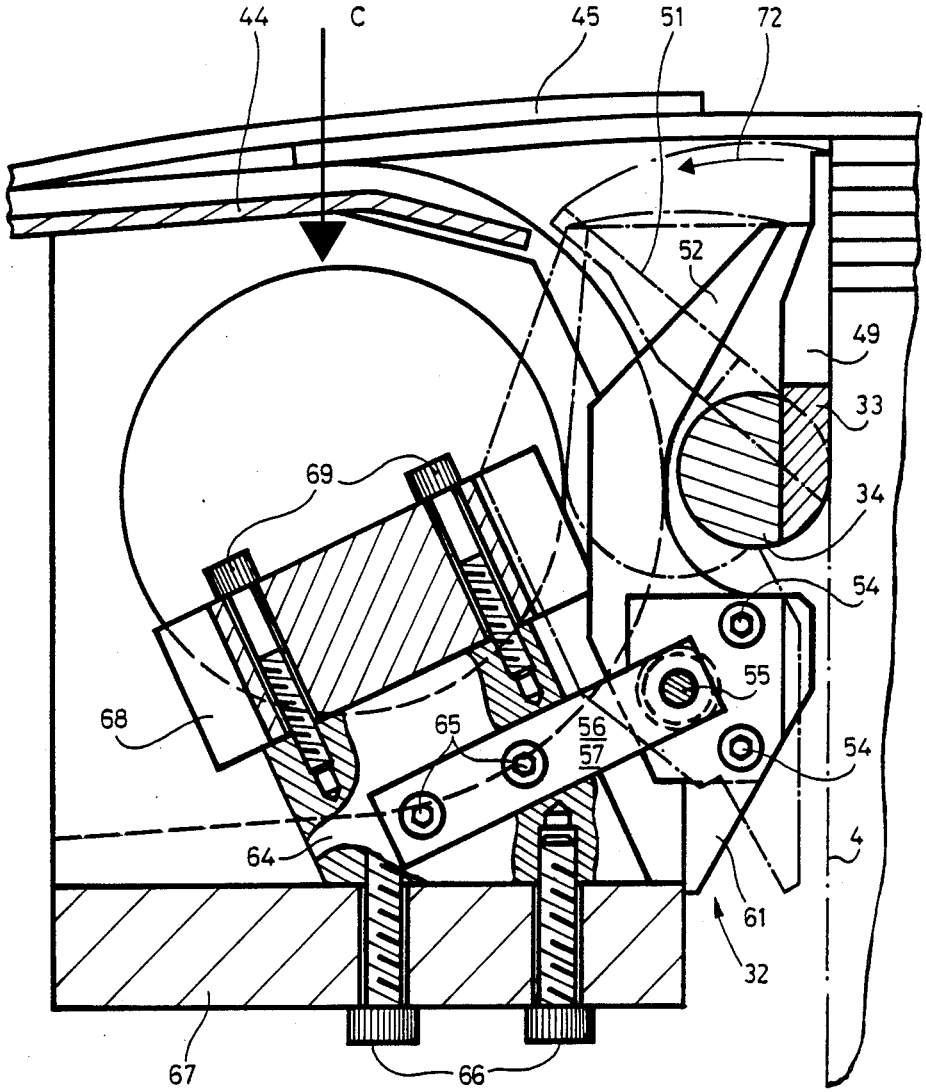
FIG. 4 is a detailed view of a preferred embodiment of the second height detection element of the infeed station at a front of the pile.

FIG. 4 is a detailed view of a first embodiment of the height detecting element of the front part of the sheet pile 4, i.e. of the second detection element 32. The front stop 33 mounted on the axis 34 is provided with a nick 49 so that when it is shifted along arrow 72 until the position 51 (shown in dash and dotted lines), the front stop 33 does not disturb detecting finger 52.

Figure 5:
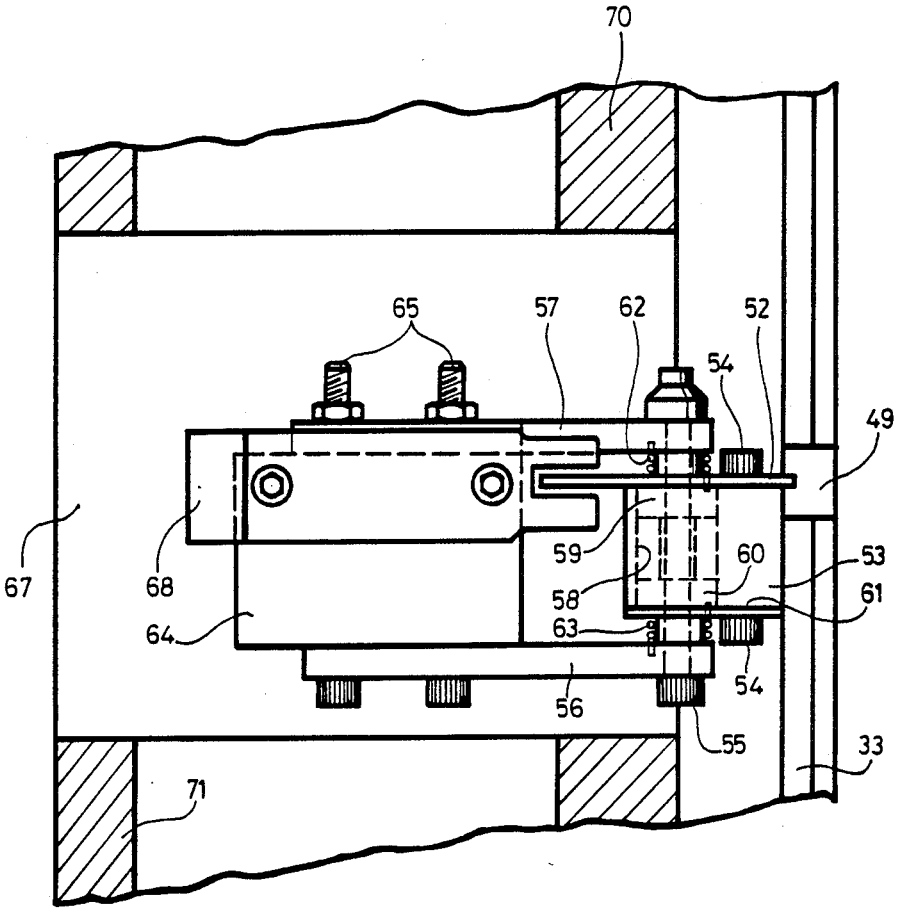
FIG. 5 is a view from a direction C in FIG. 4.

This detecting finger 52 is fastened against a bar 53 (see FIG. 5) with screws 54. The detecting finger 52 pivots around an axle 55 mounted between fasteners 56 and 57. The bar 53 is provided with a boring 58, into which the small projections 58 and 60 engage, one of these small projections being welded on a face of the detecting finger 52, while the other one is welded on a face of a stop 61 bounding the path of the detecting finger. Two springs 62 and 63, one of which is arranged between the holdfast 57 and the stops 61, and the other of which is between the holdfast 57 and the detecting finger 52, are continuously resetting the detecting finger 52 in its vertical position. The holdfasts 56 and 57 are mounted against the faces of a thickness wedge 64, and fastened with nuts 65. The thickness wedge 64 is fastened by means of screws 60, like a stirrup, on a support 67. A proximity switch 68 is mounted on the upper face of the thickness wedge 64, onto which it is fastened by the screws 69. The lateral guides 44 are fastened with means, which are not shown, against each wing 70 and 71 of the support 67. Thus, when the top of the sheet pile reaches a level where the upper passing sheet pulls the detecting finger in the direction shown by the arrow 72, the proximity switch 68 is operated and transmits a command signal to the command circuit 37 which itself generates a signal actuating the motor 11 which lifts the sheet pile 4. One could also check a sheet pile 4 with another upper face actuated detecting finger 110, actuated by the upper face 111 of the sheet pile, so that the upper sheet could rapidly reach its processing level at the start of the sheet infeed cycle. This additional detecting finger 110 is connected with a circuit of the command circuit 37 which cancels before the sheet infeed cycle the function of the first (rear height) detecting element 30 by setting it in an inoperative position so that it does not disturb the lifting of the sheet pile 4. As soon as the working level is reached, the command circuit 37 cuts the circuit of the upper face actuated detecting finger 110 and orders the lowering of the first (rear height) detecting element 30 towards the pile.

Figure 6:
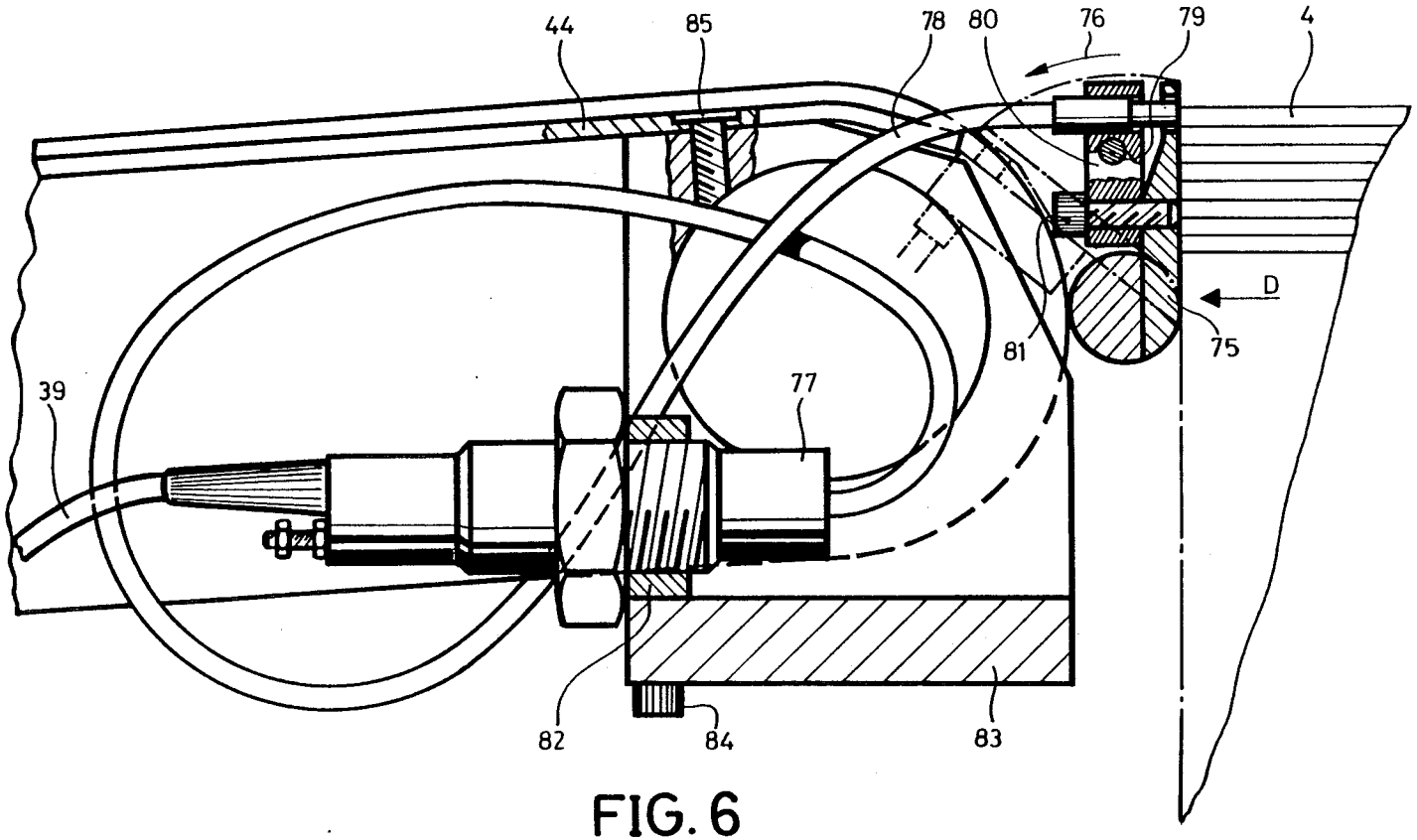
FIG. 6 is a detailed view of another embodiment of the second height detection element at the front of the sheet pile.
Figure 7:
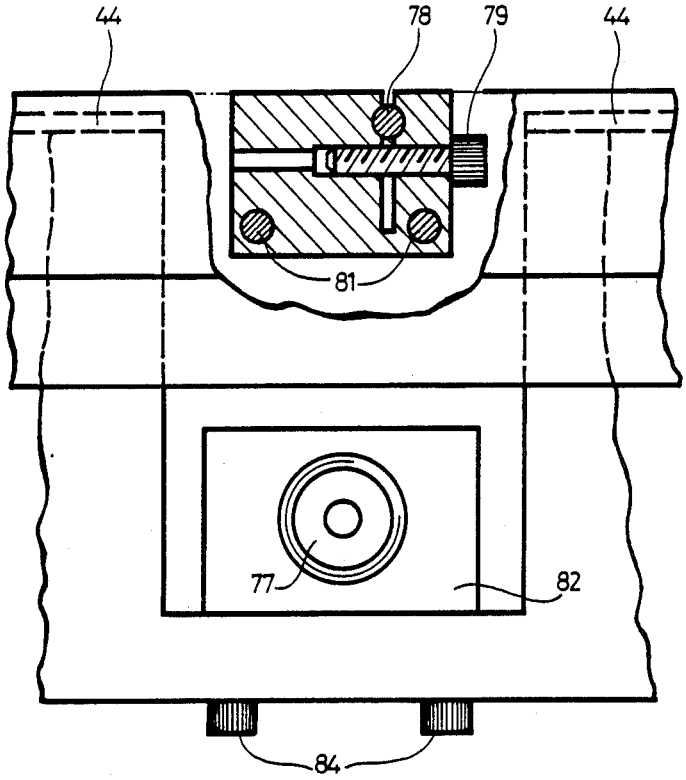
FIG. 7 is a view from a direction D in FIG. 6.
Figure 10:
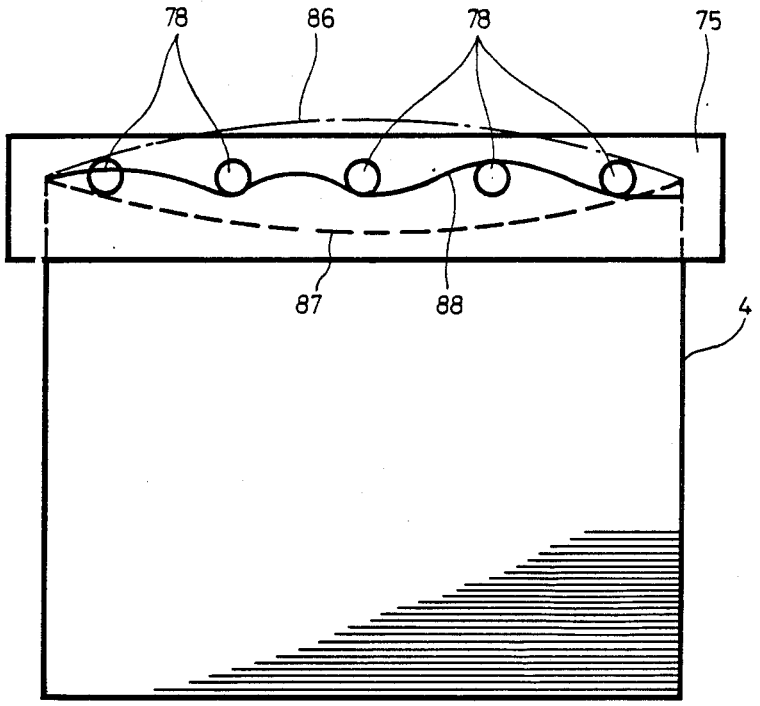
FIG. 10 is a view showing one possible arrangement of the second height detecting element at the front part of the sheet pile.

FIG. 6 shows in detail a second possible embodiment of the second detecting element 32. The sheets of the pile 4 are aligned against a front stop 75 driven in the direction of arrow 76 by elements similar to the ones driving the front stop 33 in FIG. 4. In the embodiment shown by FIG. 6, the stop 75 is connected with a detection cell by an optical fiber or waveguide 78, the end of which is tightened with a screw 79 (see FIG. 7) into a support 80 fastened against the front stop 75 with screws 81. The detection cell 77 is engaged in a plate 82 tightened against the stirrup or support 83 with screws 84. The lateral guides 44 are mounted on the wings of the stirrup 83 with screws 85. The detection cell transmits the received information to the command circuit 37 by means of a cable 39. In this embodiment, the total darkening of the end of the optical fiber 78 indicates that the upper face of the sheet pile 4 is at its ideal level, and no information is sent to the command circuit 37. When the extremity of the optical fiber 78 is no longer darkened by the upper sheet of the pile 4, the detecting cell 77 generates a signal sent to the command circuit 37, and the latter will order the lifting of the sheet pile 4 with the help of the motor 11. The command circuit 37 is provided with a discrimination circuit for allowing the reading of sheets by the cell only if the front stop 75 is in its vertical position. To check a sheet pile 4 the upper face of which is very irregular, several optical fibers 78 arranged side by side could ensure the control of the pile across its whole width. This type of embodiment is schematically shown in FIG. 10 where five optical sensors 78 are located within the front stop 75. Thus, sheet piles 4 with an upper convex bend 86 or a concave bend 87, or even a combination of both curvatures 88, can be checked.

Figure 8:
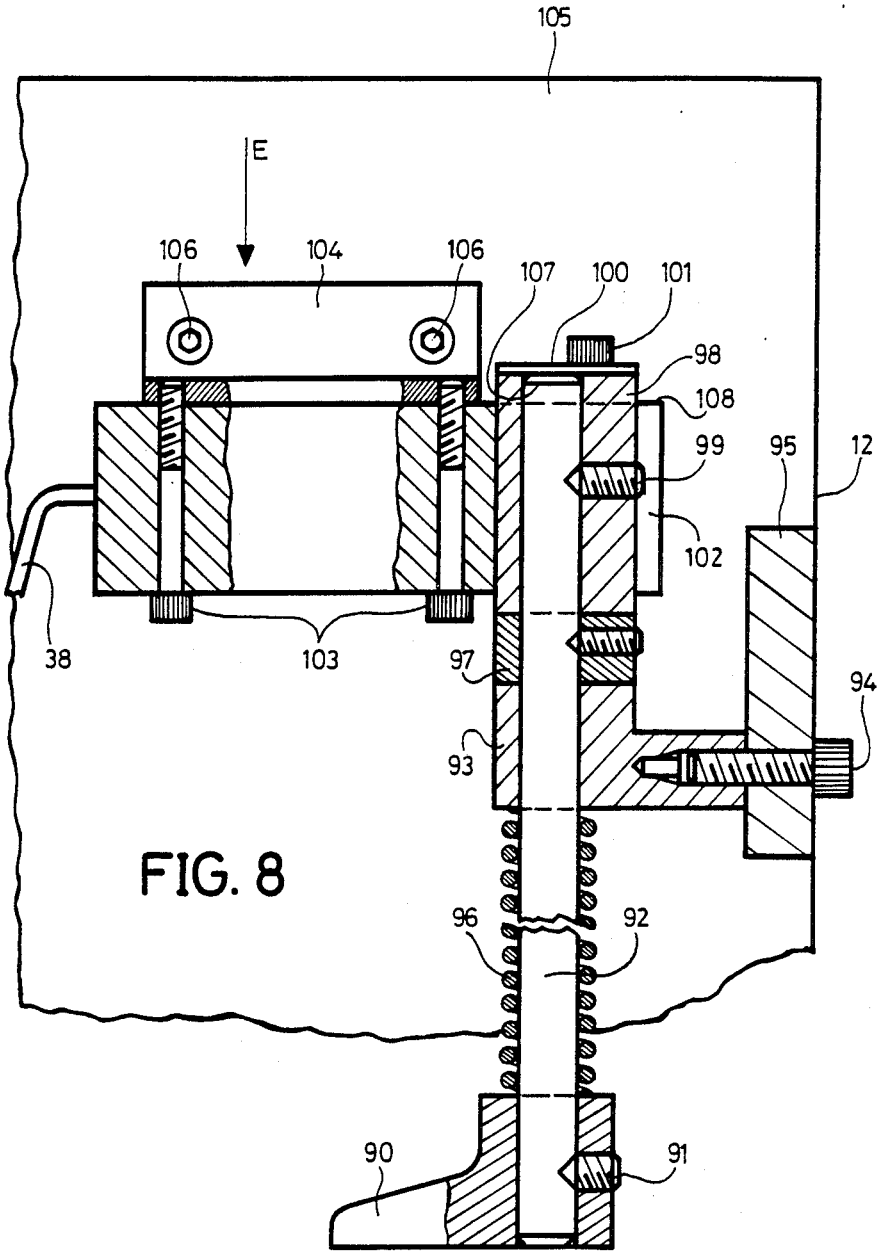
FIG. 8 is a detailed view of the first height detection element on a rear portion of the pile.
Figure 9:
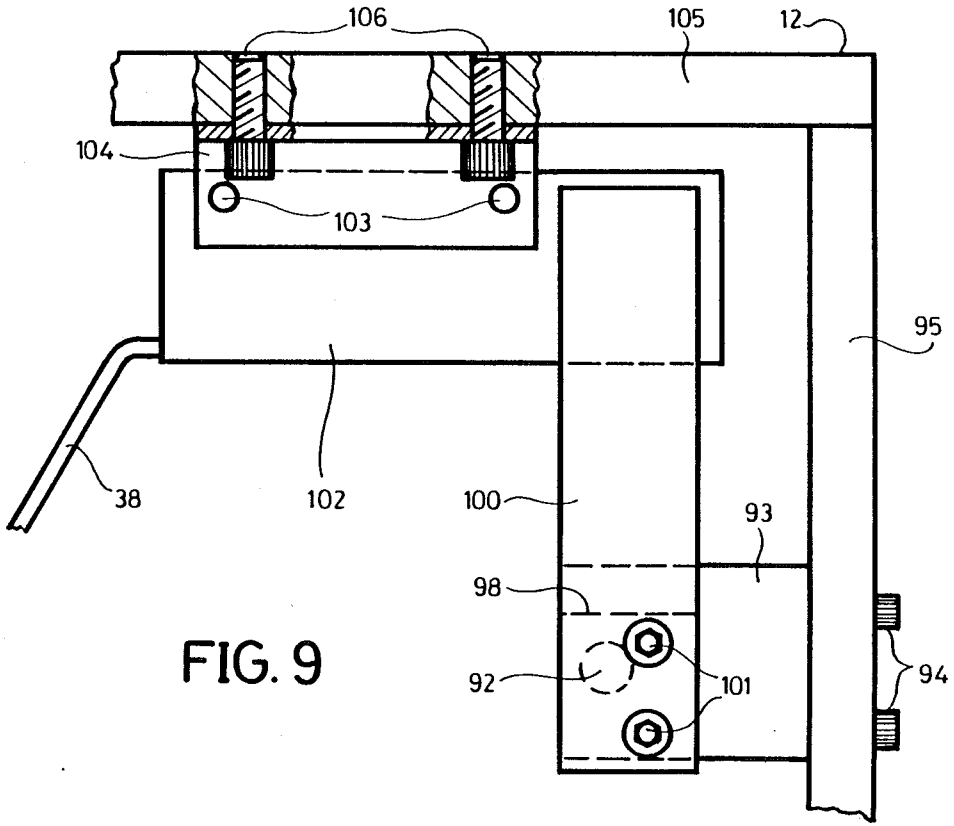
FIG. 9 is a view from a direction E in FIG. 8.

FIG. 8 shows in detail the first height detecting element 30 of the rear part of the sheet pile 4. It comprises a sensor 90 fastened with a screw 91 on one end of a rod 92 sliding in a bearing 93 fixed on a crossbar 95 of the sucker unit 12 by means of screws 94. A compression spring 96 rests on the inner face of the bearing 93 and on the upper face of the sensor 90, so that sensor 90 is always rested in its lower position, i.e. against the upper sheet of the pile 4 (see FIG. 1). The other end of the rod 92 is provided with a setting ring 97 and a bushing 98 tightened by a screw 99. The bushing 98 is equipped with a lug 100 maintained against the upper part of bushing 98 by two screws 101. The lug 100 extends over an inductive-analog type proximity detector 102 fastened with screws 103 on a square support 104 tightened with screws 106 against the inner face of the frame 105 of the sucker unit 12 (also see FIG. 9). The proximity detector 102 is connected with the command circuit 37 by the cable 38. Thus, when the distance between the inner face 107 of the lug 100 and the upper face 108 of the proximity detector 102 remains constant, a corresponding signal is transmitted by the cable 38 to the command circuit 37 which orders the motor 18 to start lowering the frame 13 supporting the sucker unit 12. If the above-mentioned distance grows, the command circuit 37 decodes the information and generates a signal towards the motor 18, so that it starts lifting the frame 13.

Consequently, the use of first and second detecting elements 30 and 32 allows the correct infeed of sheets with bends like the ones shown in dash-dot lines under reference 109 in FIGS. 1, 2 and 3, and references 86, 87 and 88 in FIG. 10. Thus, the user no longer needs installations for the secure processing of bended sheets. This noticeably increases the effective production of the processing machine and eliminates the interruptions of sheet infeed.

The previously described proximity detector 102 is part number XSC-H157621 of the French Firm "La Telemecanique". The proximity switch 68 previously described is manufactured by the Swiss firm "Hasler SA", part number 5.8400.126. Detection cell 77 is Honeywell component AFPL-25-P2.

Figure 11:
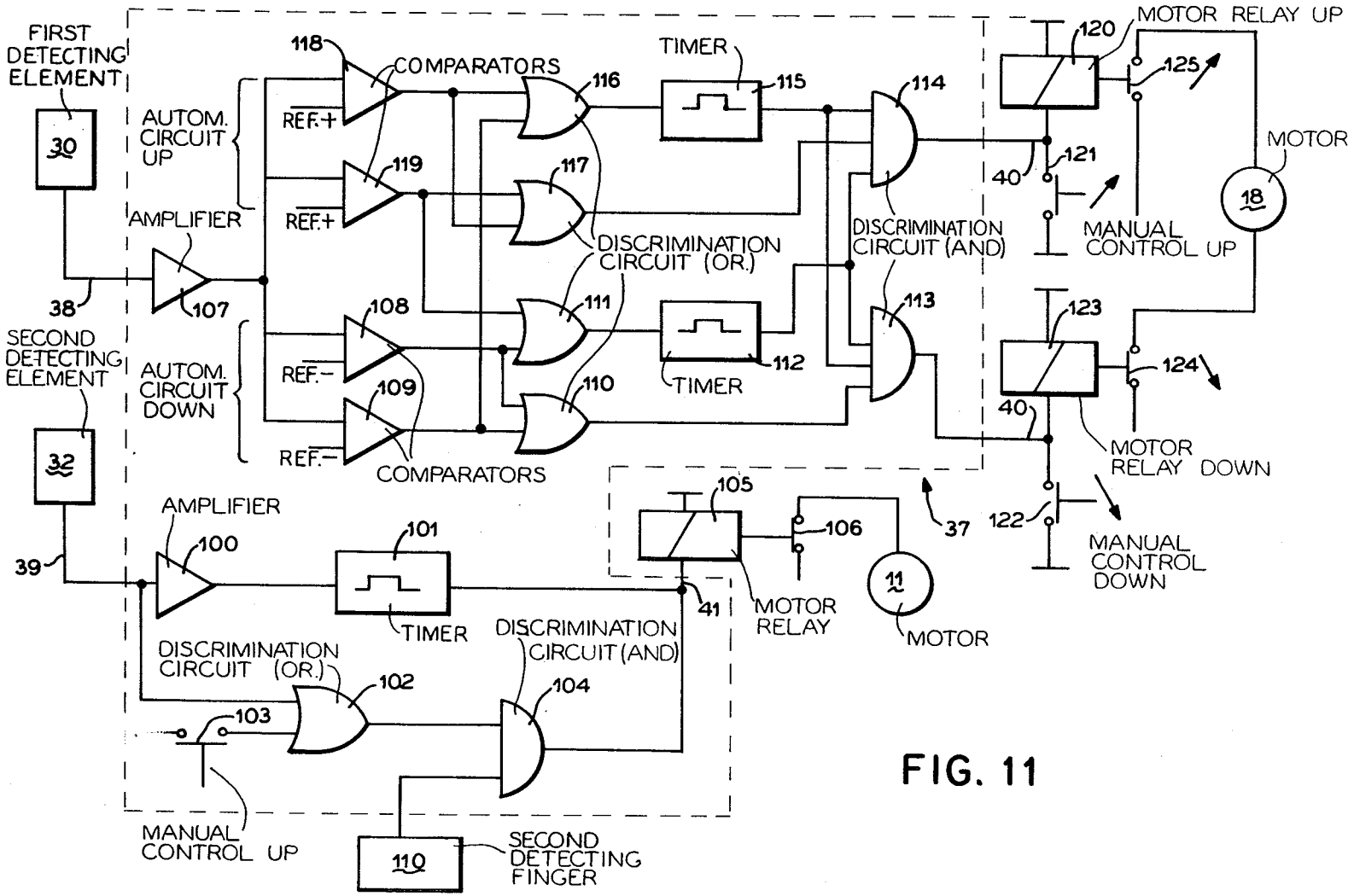
FIG. 11 is a circuit diagram of the command circuit shown in FIG. 1.

The command circuit 37 construction is illustrated in FIG. 11. As shown therein, the first detecting element 30 connects to amplifier 107 which in turn feeds automatic circuit-up comparators 118 and 119 each of which have second inputs connected to a reference. Amplifier 107 also feeds an automatic circuit-down comprising comparator 108 and 109 also having additional reference inputs. Comparator 118 outputs to discrimination circuits in the form of OR gates 116 and 117 and comparator 119 outputs to discrimination circuit OR gates 117 and 111. Comparator 108 outputs to OR gates 111 and 110 and comparator 109 outputs to OR gates 116 and 110. OR gate 116 connects through a timer 115 to discrimination circuit 114 (an AND gate) as does the output from OR gate 117. OR gate 111 connects through the timer 112 to AND gates 114 and 113 and the output of the OR gate 110 connects to AND gate 113.

Discrimination circuit AND gates 114 and 113 respectively connect to manual control-up switch 121 and manual control down-switch 122. Motor relays 120 and 123 also connect with the manual control-up and manual control-down switches, respectively for control of the motor 18.

The second detecting element 32 connects through amplifier 100 and timer 101 to motor relay 105 and associated switch 106 controlling the motor 11 for raising and controlling the pile elevator. Second detecting element 32 also feeds discrimination circuit OR gate 102 which has its other input connected to a manual control up-switch 103. OR gate 102 outputs to a discrimination circuit AND gate 104 which also has connected at its input the output from the second detecting finger 110. AND gate 104 connects to the motor relay 105 together with the output from timer 101. Motor relay 105 controls motor 11 through switch 106.

Although various minor changes and modifications might be suggested by those skilled in the art, it will be understood that I wish to include within the claims of the patent warranted hereon all such changes and modifications as reasonably come within my contribution to the art.

We claim as our invention:

1. In a system for delivering sheets taken off from and at a front of a pile in a processing machine having a pile elevator, an infeed element with suckers near a rear of the pile, and means for lifting said pile with respect to a position of the uppermost sheet, wherein the improvement comprises:

front height detection means for detecting a height of the front of the sheet pile;

command circuit means connected to the front height detection means for controlling a motor connected to raise or lower the pile elevator in direct response to the front height detection means; and rear height detection means at the rear of the sheet pile connected with said command circuit means for controlling a motor connected to lift or lower said infeed element with suckers in direct response to operation of said rear height detection means such that the rear of the sheet pile is adjusted relative to the infeed element without first observing the height of the front of the sheet pile.

2. In a system for delivering sheets taken off from a pile in a processing machine having a pile elevator, an infeed element with suckers, and means for lifting said pile with respect to a position of the uppermost sheet, wherein the improvement comprises:

front height detection means for detecting a height of a front part of the sheet pile;

command circuit means connected to the front height detection means for controlling a motor connected to raise or lower the pile elevator;

rear height detection means at a rear part of the sheet pile connected with said command circuit means for controlling a motor connected to lift or lower said infeed element with suckers;

the front height detection means comprising a first detecting finger mounted on a median theoretical axis of the sheet pile such that it can pivot around an axle mounted between two holdfasts when it is driven by a sheet of the pile;

at least one proximity switch actuated by said first detecting finger; and a second detecting finger actuated by an upper face of the sheet pile.

3. A system according to claim 1 wherein the front height detecting means comprises a first detecting element formed of an optical detection cell connected with an optical waveguide, and a second detecting element positioned to be actuated by an upper face of the sheet pile.

4. A system according to claim 1 wherein the rear height detection means comprises a sensor with a lug extending over a proximity detector connected with the command circuit means.

5. A system according to claim 1, wherein two lower conveyors and two upper conveyors are arranged on both sides of a median theoretical axis of the sheet pile, said conveyors being located downstream of the sheet pile between two lateral guides.

6. A system for controlling the delivery of sheets taken off from and at a front of a pile in a processing machine having a motor controlled pile elevator and upper sheet infeed means near a rear of the pile whose height with respect to a top sheet of the pile is adjustable by a motor, comprising:

front height detection means for detecting a height of the front of the sheet pile;

command circuit means connected to the front height detection means and to the pile elevator motor for automatically regulating the pile elevator in direct response to operation of the front height detection means so as to maintain said uppermost sheet at a desired height;

a rear height detection means at the rear of the sheet pile and the infeed means height adjusting motor also being connected with said command circuit means; and said command circuit means controlling the infeed means height adjusting motor means in direct response to the rear height detection means so as to maintain a predetermined height between the infeed means and the uppermost sheet as detected at the rear height detection means such that the rear of the sheet pile is adjusted relative to the infeed means without first observing the height of the front of the sheet pile.

7. A system for controlling the delivery of sheets taken off from a pile in a processing machine having a motor controlled pile elevator and upper sheet infeed means whose height with respect to a top sheet of the pile is adjustable by a motor, comprising:

front height detection means for detecting a height of a front part of the sheet pile;

command circuit means connected to the front height detection means and to the pile elevator motor for automatically regulating the pile elevator so as to maintain said uppermost sheet at a desired height;

a rear height detection means at a rear part of the sheet pile and the infeed means height adjusting motor also being connected with said command circuit means;

said command circuit means controlling the infeed means height adjusting motor means so as to maintain a predetermined height between the infeed means and the uppermost sheet as detected at the rear height detection means;

the front height detecting means comprising first and second detecting elements;

the first detecting element being positioned at a front upper portion of the sheet pile and a second detecting element being positioned so as to detect an upper face of the pile;

the first and second detecting elements being connected to the command circuit means; and said command circuit means prior to a sheet infeed cycle making the rear height detection means inoperative so that it does not disturb a lifting of the sheet pile, and wherein when a working level is reached, said command circuit means deactivating the second detecting element and activating the rear height detection means.

8. A system according to claim 6 wherein the infeed means comprises a sucker unit.

9. In a system for delivering sheets taken off from a pile in a processing machine having a pile elevator, a suction infeed element, and means for lifting the pile with respect to a position of the uppermost sheet, wherein the improvement comprises:

front height detection means for detecting the height of a front part of the sheet pile;

command circuit means connected to the front height detection means for controlling a motor connected to raise or lower the pile elevator;

rear height detection means at a rear part of the sheet pile connected with said command circuit means for controlling a motor connected to lift or lower said suction infeed element; and the front height detection means comprising first and second detecting fingers positioned so that one of the fingers is directly actuated by a driven top sheet of the pile and the other finger is positioned to detect an upper front side edge of the pile.

10. A system for controlling the delivery of sheets taken off from a pile in a processing machine having a motor controlled pile elevator and upper sheet infeed means whose height with respect to a top sheet of the pile is adjustable by a motor, comprising:

front height detection means for detecting a height of a front part of the sheet pile;

command circuit means connected to the front height detection means and to the pile elevator motor for automatically regulating the pile elevator so as to maintain said uppermost sheet at a desired height;

a rear height detection means at a rear part of the sheet pile and the infeed means height adjusting motor also connected with said command circuit means;

the front height detecting means comprising first and second detecting elements connected to the command circuit means, the first and second detecting elements being positioned near a front upper portion of the sheet pile; and said command circuit means making the rear height detection means inoperative as the sheets are lifted and then rendering operative the rear height detection means after the sheets have reached a working level.

* * * * *